US012350551B2

(12) United States Patent
Miller et al.

(10) Patent No.: US 12,350,551 B2
(45) Date of Patent: Jul. 8, 2025

(54) MOUTH INSERT FOR ONE-WAY BREATHING

(71) Applicant: Mitsuko and Masako, LLC, Westcliffe, CO (US)

(72) Inventors: Darrin Miller, Palisade, CO (US); Brad Anderson, Westcliffe, CO (US)

(73) Assignee: Mitsuko and Masako, LLC, Westclife, CO (US)

( * ) Notice: Subject to any disclaimer, the term of this patent is extended or adjusted under 35 U.S.C. 154(b) by 155 days.

(21) Appl. No.: 18/243,071

(22) Filed: Sep. 6, 2023

(65) Prior Publication Data

US 2024/0091588 A1 Mar. 21, 2024

Related U.S. Application Data

(60) Provisional application No. 63/407,313, filed on Sep. 16, 2022.

(51) Int. Cl.
*A63B 23/18* (2006.01)

(52) U.S. Cl.
CPC ..... *A63B 23/18* (2013.01)

(58) Field of Classification Search
CPC ..... A63B 23/18; A61M 16/06–0694
See application file for complete search history.

(56) References Cited

U.S. PATENT DOCUMENTS 4,062,358 A * 12/1977 Kritzer ..... A63B 21/00069 482/13
4,739,987 A * 4/1988 Nicholson ..... A63B 23/18 482/13
5,249,570 A 10/1993 Cox
5,954,049 A 9/1999 Foley et al.
7,543,653 B2 6/2009 Reilly et al.
(Continued)

FOREIGN PATENT DOCUMENTS

EP 3954418 A1 * 2/2022 ..... A61M 16/0006

OTHER PUBLICATIONS

"A New Nasal Restriction Device Called FeelBreathe® Improves Breathing Patterns in Chronic Obstructive Pulmonary Disease Patients during Exercise"; https://www.ncbi.nlm.nih.gov/pmc/articles/PMC7370091/; Retrieved from https://www.ncbi.nlm.nih.gov/pmc/articles/PMC7370091/ on Jul. 27, 2022.
(Continued)

*Primary Examiner* — Nyca T Nguyen
(74) *Attorney, Agent, or Firm* — Burdick Patents, P.A.; Sean D. Burdick; Colin L. Honan

(57) ABSTRACT

A one-way breath training device has a mouth insert engaged to a cage housing a movable baffle. The mouth insert has an air hole extending from a first end to a second end. The baffle moves within the cage between a backstop having air pathways therethrough to the second end of the mouth insert. The cage has one or more guidance tracks which the baffle moves along. When a user attempts to inhale through their mouth, the inflow of air pulls the baffle against the second end and blocks the air hole to prevent further air from entering the air hole. When a user exhales through the mouth insert, the outflowing air pushes the baffle against the backstop of the cage thereby opening the air hole and air pathways for the exhaled air to escape.

17 Claims, 7 Drawing Sheets

(56) References Cited

U.S. PATENT DOCUMENTS

| | | | | |
|---|---|---|---|---|
| 7,650,885 | B2 | 1/2010 | Paoluccio et al. | |
| 8,079,998 | B2 | 12/2011 | Hole et al. | |
| 8,240,309 | B2 | 8/2012 | Doshi et al. | |
| 8,573,219 | B2 | 11/2013 | Wondka | |
| 9,399,105 | B2 | 7/2016 | Frater | |
| 9,623,203 | B2 | 4/2017 | Nitta et al. | |
| 9,849,260 | B2 | 12/2017 | Black et al. | |
| 10,046,133 | B2 | 8/2018 | Kapust et al. | |
| 10,258,758 | B1 * | 4/2019 | Faram | A61M 16/0833 |
| 10,279,142 | B2 | 5/2019 | Witt et al. | |
| 10,569,043 | B2 | 2/2020 | Tatkov | |
| 10,610,228 | B2 | 4/2020 | Cline et al. | |
| 10,675,428 | B2 | 6/2020 | Guney et al. | |
| 10,780,318 | B1 * | 9/2020 | Ghazzawi | A63B 23/18 |
| 10,926,051 | B2 * | 2/2021 | Collazo | A61M 16/0666 |
| 11,260,197 | B2 | 3/2022 | Meyer et al. | |
| 11,452,838 | B2 * | 9/2022 | Rusher | A61M 16/208 |
| 2008/0257358 | A1 | 10/2008 | Stern et al. | |
| 2012/0000472 | A1 * | 1/2012 | Martucci | A61M 16/049 128/205.24 |
| 2013/0019870 | A1 | 1/2013 | Collazo et al. | |
| 2015/0258370 | A1 * | 9/2015 | Arkush | A61B 5/087 482/8 |
| 2016/0346603 | A1 * | 12/2016 | Halliday | A61M 16/208 |
| 2017/0136205 | A1 * | 5/2017 | Rusher | A61M 16/208 |
| 2019/0046757 | A1 * | 2/2019 | Boutros | A61M 15/0018 |
| 2019/0299055 | A1 * | 10/2019 | Poulsen | A63B 23/18 |
| 2020/0015997 | A1 | 1/2020 | Michalak et al. | |
| 2022/0040555 | A1 * | 2/2022 | Mueller | A63B 23/18 |

OTHER PUBLICATIONS

"Fact or Fad? The Research Behind Breath Training Products for Ultimate"; https://www.theuap.com/blog/breath-training-for-ultimate; Retrieved from https://www.theuap.com/blog/breath-training-for-ultimate on Jul. 27, 2022.

"Obstructive Sleep Apnea: Gadgets and Devices"; https://www.webmd.com/sleep-disorders/sleep-apnea/sleep-apnea-gadgets#1; Retrieved from https://www.webmd.com/sleep-disorders/sleep-apnea/sleep-apnea-gadgets#1 on Jul. 27, 2022.

"The case against inspiratory muscle training in COPD"; https://erj.ersjournals.com/content/37/2/236; Retrieved from https://erj.ersjournals.com/content/37/2/236 on Jul. 27, 2022.

Airofit; https://www.airofit.com/how-does-it-work/; Retrieved from https://www.airofit.com/how-does-it-work/ on Jul. 27, 2022.

The Breather; https://www.thebreather.com.au/products/; Retrieved from https://www.thebreather.com.au/products/ on Jul. 27, 2022.

Does Running With a Training Mask Actually Work?; https://www.runnersworld.com/training/a34984200/running-with-an-elevation-training-mask/; Retrieved from https://www.runnersworld.com/training/a34984200/running-with-an-elevation-training-mask/ on Jul. 27, 2022.

Expand-A-Lung; https://expand-a-lung.com/exercise-instructions/; Retrieved from https://expand-a-lung.com/exercise-instructions/ on Jul. 27, 2022.

Good Morning Snore Solution; https://goodmorningsnoresolution.com/pages/how-it-works; Retrieved from https://goodmorningsnoresolution.com/pages/how-it-works on Jul. 27, 2022.

Nose Breathe® Trainer; https://www.amazon.com/Nose-Breathe%C2%AE-TrainerExperience-Breathing/dp/B01FUKIYJS; Retrieved from https://www.amazon.com/Nose-Breathe%C2%AE-TrainerExperience-Breathing/dp/B01FUKIYJS on Jul. 27, 2022.

* cited by examiner

MOUTH INSERT FOR ONE-WAY BREATHING

RELATED APPLICATIONS

This application claims priority to U.S. Provisional Application No. 63/407,313, filed Sep. 16, 2022, which is fully incorporated herein by reference.

BACKGROUND OF THE INVENTION

Field of the Invention

The present invention relates generally to mouthpieces, and more specifically to training mouthpieces that are designed to prevent inhalation by the mouth.

Description of Related Art

Breathing is the body's automated response to carbon dioxide levels in the body exceeding a certain threshold. When that threshold is exceeded, the brainstem sends a signal to the respiratory muscles to inhale air. Upon exhalation, the carbon dioxide levels in the body drop and a new breathing cycle begins.

While breathing occurs naturally and automatically in the body, many people breathe incorrectly. That is, many people breathe only using their mouth and do not inhale or exhale through their nose.

Inhaling primarily through the mouth is known to cause and/or contribute to many health issues. These issues can further be exacerbated in overweight or obese persons as well. For instance, it is known that inspiring primarily through the mouth can contribute to many sleep disorders, including sleep apnea. Further, inspiration by the mouth while sleeping is likely to result in or increase snoring, which can ultimately prevent a person from obtaining a full restful night of sleep. In addition to being tired during the day from a lack of restful sleep, a lack of sleep can contribute to more significant health problems such as weight gain and behavioral issues.

Inspiration by the mouth, during wakefulness or rest, can also contribute to bad breath and/or dry mouth and throat. Consistent dry mouth and throat can further lead to a number of oral diseases, including gum disease and tooth decay.

The nose acts as the body's natural filtration system. The hairs found in a person's nose can capture small particles, such as pollen or other allergens and even bacteria or other unwanted microorganisms. Inhalation by the mouth completely bypasses this natural filtration system, allowing the allergens or microorganisms direct access to the body. This can result in an increased sensitivity to allergens and may even result in recurring upper respiratory illness.

The nose also acts as a temperature buffer between the ambient air and the lungs. Air that is taken in through the nose is forced through intricate structures within the nasal cavity, called turbinates, before being introduced to the lungs. These structures aid in regulating the temperature and humidity of the air before it passes to the lungs as well as providing additional filtration of that air. Air that is more closely matched to the temperature and humidity within the lungs can be taken up easier in the bloodstream and thus result in better oxygen levels in the blood. Inhaling primarily by the mouth avoids these nasal structures, preventing the temperature and humidity of the inhaled air from being balanced to those levels found in the lungs.

Aside from the adverse health impacts of inspiration by the mouth, it can also be detrimental during active training or physical activity. Inhaling by the mouth during training or other physical activity is common because it allows a person to take in more air than compared to breathing primarily through the nose. However, the actual amount of oxygen that will make it into the bloodstream may be lower than an equivalent intake breath through the nose. Further, breathing in through the nose allows the person to better control their heart rate and actually slow their breathing. In combination, this can result in a quicker recovery back to the person's baseline levels. Quicker recovery during training or other physical activity can increase a person's overall performance. Nose breathing during active training sessions can also allow the person to maintain a lower, more controlled heart rate, allowing them to train longer and harder.

The problem is that many people find nose breathing to be difficult or otherwise uncomfortable. This is because they have trained their bodies to subconsciously bypass the nose during breathing and only use their mouth. There have been several attempts by others to address this problem either through use of some type of facemask or other mouth covering device to restrict inhaling through the mouth. However, a common failure among these attempts is that the device restricts air intake through the mouth but does not completely block or prevent the air from flowing in. While a person using these devices may think they are training themselves to breathe through their noses, the restricted intake at the mouth can actually reinforce the inspiration by mouth habit. That is, by only restricting the air intake at the mouth, the person is still able to intake some air through the mouth, and if they inhale hard enough maybe even a full breath is taken in, which trains the body and the brain to inhale deeper and harder through the mouth, thus defeating the purpose of these prior art solutions.

Thus, what is needed a device that can completely restrict or otherwise block air being taken in through the mouth so as to train the person to breathe in primarily through their nose.

SUMMARY OF THE INVENTION

According to the invention disclosed herein, a mouthpiece for one-way breathing is disclosed. In general, the inventive mouthpiece has a movable baffle that will block an air hole when a user attempts to inhale through their mouth.

In particular embodiments, the inventive training device includes a mouth insert having an air hole defined therethrough. A first end of the insert is designed to engage a user's mouth and a second, opposite, end is designed as an impact surface. The air hole extends through the insert from the first end to the second end. A cage is engaged to the second end of the insert and has at least one guiding track and a backstop. The backstop is opposite the impact surface of the insert and is designed to allow air to pass through the cage and into the air hole. A baffle is housed within the cage and is movable between the backstop and the impact surface. The baffle is configured to block the inflow of air at the air hole when a user attempts to inhale through their mouth. Thus, the baffle moves along the guiding tracks to the impact surface and blocks the air hole when a person inhales through the mouth insert. Similarly, the baffle moves along the guiding tracks to the backstop upon a positive outflow of air through the air hole, e.g., the baffle moves to the backstop when a person exhales through the mouth insert. In some embodiments, an audible alert is generated when the air hole is blocked. The audible alert may be generated by the movement of the baffle against the impact surface of the second end.

In some embodiments, the second end of the mouth insert has a means to removably connect the insert to the cage. The removable connection means may be a snap-fit engagement between the second end of the mouth insert and the cage. In some embodiments, the first end of the mouth insert may include a retaining ring formed at the proximal end thereof. The first end may be configured to removably engage with an opening of a mouthpiece. The opening of the mouthpiece may further include a groove circumvolving the inner perimeter of the opening. The groove of the mouthpiece is designed to engage with the retaining ring formed on the mouth insert. The mouthpiece may be a conventional mouthpiece or mouth guard made from a synthetic material, such as rubber, and provides a bite surface for a user's mouth to grip when using the disclosed invention.

In some embodiments, there may be multiple guiding tracks formed with the cage. Each of the guiding tracks may have a defined curvature from the distal end of the cage to the proximal end of the cage. The curvature of the guiding tracks is designed to minimize friction generated between the baffle and the guiding tracks during inhalation or exhalation through the disclosed device. The baffle may be a free floating disk having rounded edges that move along the guiding tracks. The guiding tracks and backstop of the cage are designed so that the baffle cannot escape or otherwise dislodge from the cage unless the cage has been removed from the mouth insert.

In some embodiments, the cage may include a plurality of guiding tracks. The guiding tracks may be integrally formed with an inside surface of the cage. In some embodiments, the guiding tracks may be integrated with the backstop such that the backstop and the guiding tracks are a single molded component.

The backstop may be partially opened so as to allow the passage of air therethrough. One or more flow paths are defined in the cage when the baffle is positioned against the backstop. The total cross-sectional area of these flow paths is substantially equal to the minimum cross-sectional area of the air hole.

In further embodiments, the cage has an oval shape and the guiding tracks define an open oval-shaped area to house the baffle within the cage. The baffle can be an oval-shaped free-floating disc having a surface area less than the surface area of the open oval-shaped area of the cage.

The cage may also include a retaining clip. The retaining clip may be used to attach the disclosed training device to a keychain or lanyard or other such similar devices to ensure the training device does not become lost when not in use.

BRIEF DESCRIPTION OF THE DRAWINGS

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims. Component parts shown in the drawings are not necessarily to scale, and may be exaggerated to better illustrate the important features of the invention. Dimensions shown are exemplary only. In the drawings, like reference numerals may designate like parts throughout the different views, wherein:

DETAILED DESCRIPTION OF THE INVENTION

The following disclosure presents exemplary embodiments for a device for training a person to inhale through their nose. Particularly, the disclosure presents exemplary embodiments of multi-piece mouthpiece for completely blocking and preventing air intake through a person's mouth. In some embodiments an audible alert is generated when a person attempts to breathe in through their mouth using the present device. Methods for training proper breathing using the present device are also described.

Figure 1:
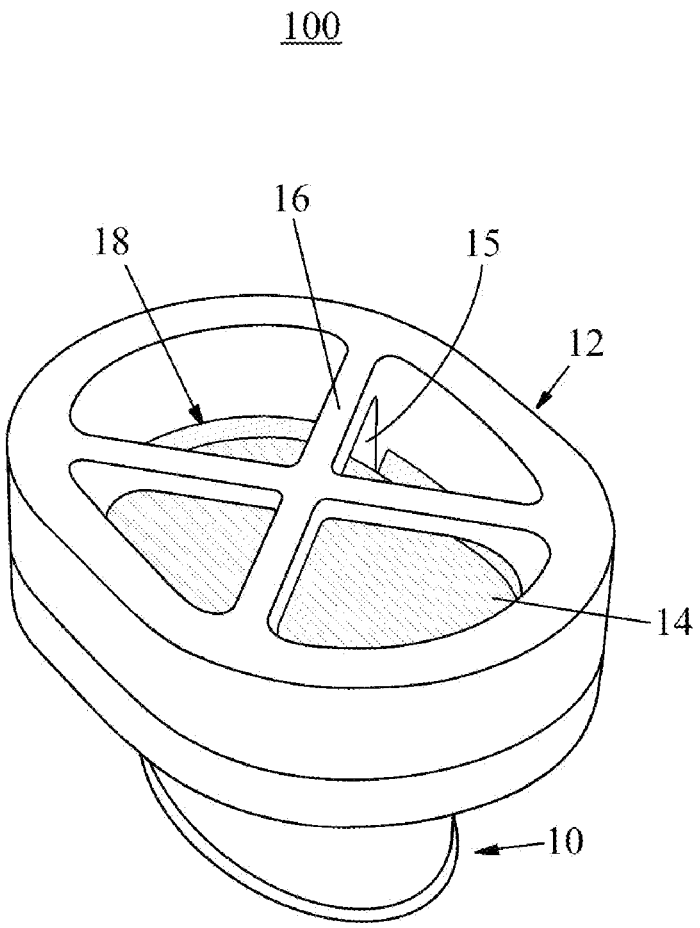
FIG. 1 is a perspective top view of one embodiment of a one-way breath training device according to the present invention.

FIG. 1 is a perspective view of one embodiment according to the invention of a one-way breath trainer 100. The one-way breath trainer 100 has a mouth insert 10 connected to a cage 12. Housed within the cage 12 is a free-floating planar baffle 14. The free-floating planar baffle 14 is movable between the mouth insert 10 and a distal end of the cage 12 as a freely movable disc. The cage 12 includes at least one guidance track 15 formed on an inside surface of the cage and defining a depth of movement for the free-floating planar baffle 14. The guidance tracks 15 have a defined curvature from the distal end of the cage 12 toward the proximal end. The curvature of the guidance tracks 15 is configured to assist in containing the free-floating planar baffle 14 within the cage 12 as well as aid in centering the planar baffle within the one-way breath trainer 100. Further, the curvature of the guidance tracks 15 is designed to minimize friction between the tracks and an outer edge of the baffle 14 thereby allowing the baffle to move with minimal force requirements.

The distal end of the cage 12 also has an integral backstop 16. The guidance track 15 may also form part of the backstop 16. The backstop 16 is designed to keep the free-floating planar baffle 14 contained within the cage and prevents the baffle from dropping out or otherwise becoming disengaged from the one-way breath trainer 100. The backstop 16 is also designed with at least one opening 18 defined therethrough. The opening 18 allows for passage of air through the backstop. Preferably, a plurality of openings 18 are defined through the backstop 16 to ensure a sufficient amount of airflow can be achieved. In preferred embodiments, the backstop 16 is configured as an X defining four openings 18 therethrough. The X-shaped backstop 16 ensures the free-floating planar baffle 14 is sufficiently contained within the one-way breath trainer 100 while simultaneously ensuring there is sufficient open space for airflow to move through the breath trainer.

In some preferred embodiments, the baffle 14 is movable under forces generated by normal human inspiration. For purposes of this disclosure, the phrase "normal human inspiration" is understood to mean the average volume of air taken in with each inhalation, under normal breathing pressures, by a human. In the relevant field, this volume of air is typically referred to as tidal volume and has been found to be between about 400 milliliters (mL) and about 600 mL of air for the average healthy adult. Further, normal breathing pressures for an average healthy adult have been found to be between about 1 pounds per square inch (psi) and 2 psi. Therefore, the baffle 14 is configured to be movable under the forces generated by an average healthy adult human being inhaling between about 400 mL and 600 mL of air at pressures of between about 1-2 psi. It should be obvious to the skilled artisan that the baffle 14 will remain movable under forces generated by larger tidal volumes being inhaled under high pressures, for example, during certain types of strenuous exercise. Thus, movement of the baffle 14 within the cage 12 requires minimal effort by a user. The baffle 14 will be freely movable under virtually any use-case scenario, including while a user is at rest and during strenuous exercise.

Figure 2:
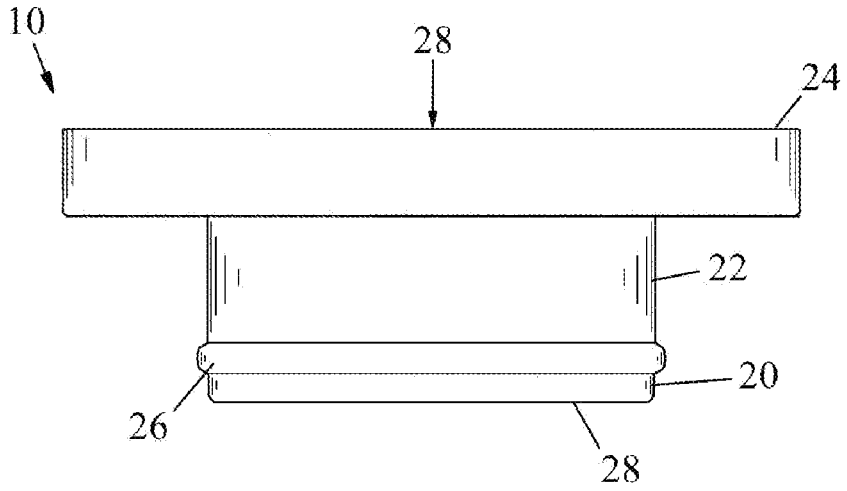
FIG. 2 is a side view of an embodiment of a mouth insert for use in a one-way breath training device according to the present invention.

FIG. 2 is a side view of the mouth insert 10. In this first embodiment of the mouth insert 10, there is a first end 20 with an elongated section 22 extending toward a second end 24. The first end 20 is configured for insertion in a user's mouth and has a retaining ring 26 formed in a proximal end thereof. The mouth insert 10 is designed such that a user can insert the first end 20 in the user's mouth and surround the elongated section 22 with the user's lips while the retaining ring 26 abuts the backside of their teeth. Thus, the retaining ring 26 provides an engagement surface for a user's teeth to contact and easily hold the mouth insert in their mouth.

Figure 3:
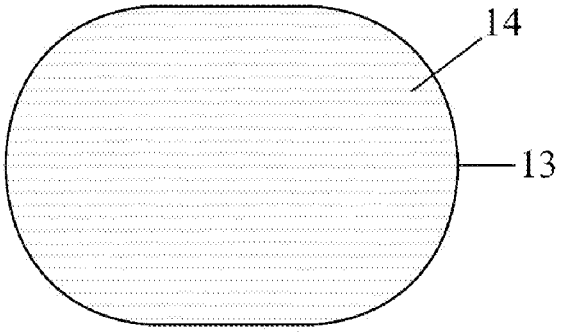
FIG. 3 is a top view of an embodiment of a baffle for use in the one-way breath training devices according to the present invention.

FIG. 3 is an isolated view of one embodiment of the free-floating planar baffle 14. In preferred embodiments, the free-floating planar baffle 14 is configured as an oval shaped disc that is freely movable between the backstop 16 of the cage 12 and the air hole 28 of the mouth insert 10. The free-floating planar baffle 14 is sized such that it can completely block the air hole 28 to prevent air from moving through the mouth insert 10. The free-floating planar baffle 14 is sucked in against the air hole 28 when a user attempts to inhale through their mouth to block any additional air from moving through the hole 28.

In preferred embodiments, the free-floating planar baffle 14 has rounded edges 13. The rounded edges 13 work in conjunction with the curvature of the guidance tracks 15 to provide an uninhibited adjustment and reorientation of the free-floating planar baffle 14 within the one-way breath trainer 100. The rounded edges 13 allow for a smooth alignment and realignment along the curvature of the guidance tracks 15 by minimizing the friction generated between the moving parts. This design is particularly useful at preventing the free-floating planar baffle 14 from becoming lodged at an angle along the guidance tracks 15 that prevents movement of the baffle in the cage 12. Further, the design promotes the free movement of the free-floating planar baffle 14 within the cage 12.

Figure 4:
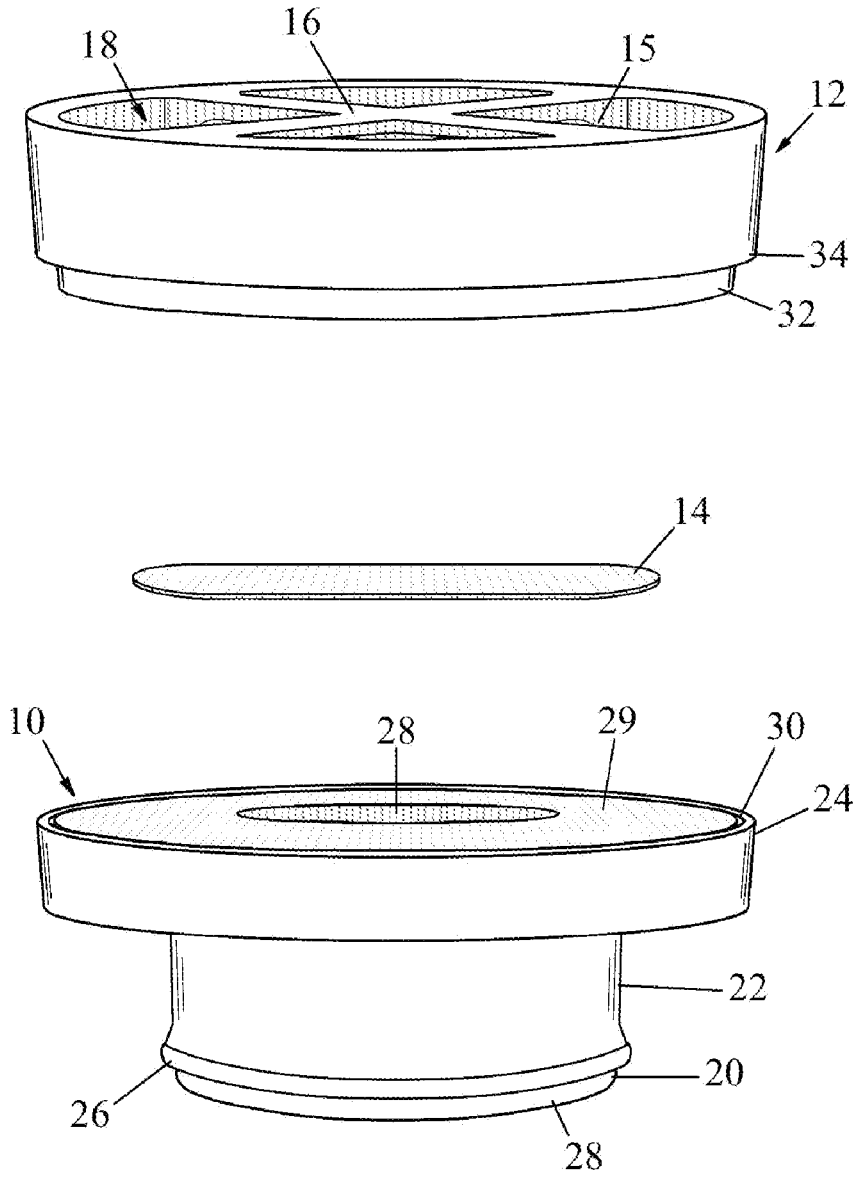
FIG. 4 is an exploded perspective side view of an embodiment of a one-way breath training device according to the present invention.

FIG. 4 is an exploded view of an embodiment of the one-way breath trainer 100. An air hole 28 is defined substantially in the middle of the insert 10 and extends from the first end 20 through the elongated section 22 to the second end 24. In preferred embodiments, the air hole 28 has a substantially oval shape that is smaller than the overall surface area of the free-floating planar baffle 14. The second end 24 has an impact surface 29 surrounding the air hole 28. The impact surface 29 provides a planar surface which the free-floating planar baffle 14 engages to cover the air hole 28. The second end 24 of the insert 10 also has a means for connecting the insert to the cage 12. Preferably, the insert 10 is connected to the cage 12 via snap fit engagement. The cage 12 has a ridge 32 formed around the perimeter of a forward end 34 that snaps into engagement with a groove 30 defined substantially around the outer perimeter of the impact surface 29 at the second end 24. Other connection mechanisms may also be used, such as magnets, threads, or any other conventional attachment means. Alternatively, the cage 12 and the mouth insert 10 may be formed as a single component piece with the baffle 14 positioned to be free floating therein.

Figure 5:
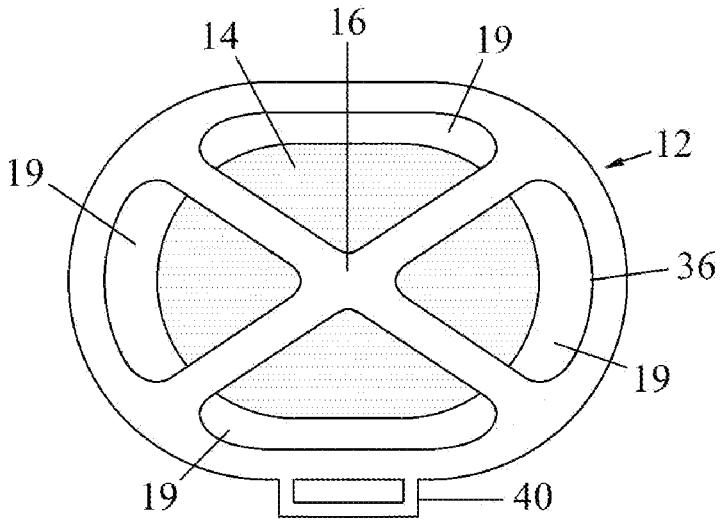
FIG. 5 is a front view of an embodiment of a cage for use with a one-way breath training device according to the present invention and having a baffle moved to its maximum distal position.
Figure 6:
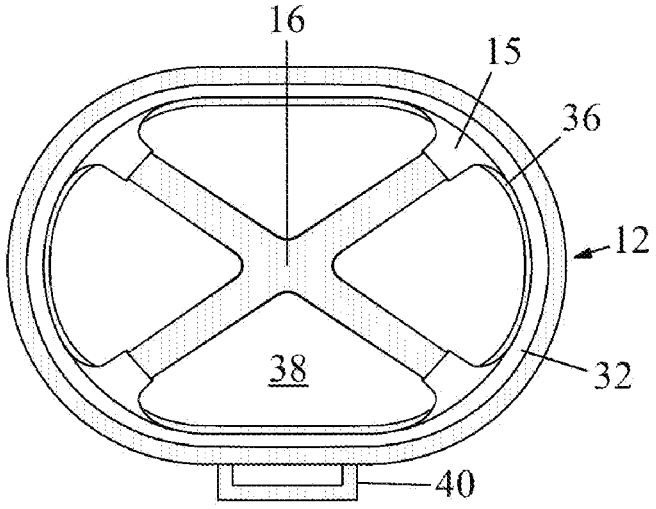
FIG. 6 is a back view of the cage from FIG. 5 with the baffle removed.

FIG. 5 is a back view of an embodiment of the cage 12. FIG. 6 is a front view of the cage of FIG. 5. The cage 12 includes at least one guidance track 15. In preferred embodiments, there are multiple guidance tracks 15, each with a defined curvature, as best shown in FIG. 1 and described above. The guidance tracks 15 are designed to provide a contact surface along which the free-floating planar baffle 14 can slide as it moves between the insert 10 and the backstop 16 of the cage 12. Preferably, four guidance tracks 15 are formed integrally around an inside surface 36 of the cage 12 and spaced substantially equidistant from one another. The integrally formed guidance tracks 15 may extend to form an x-shaped backstop 16 defining four openings 18 through which air passes freely. The guidance tracks 15 define an open space 38 formed within the cage. The open space 38 is less than the total surface area defined by the inside surface 36 of the cage. In preferred embodiments, the free-floating planar baffle 14 is freely movable within the open space 38 formed between the tracks 15 and the backstop 16.

In some embodiments, the inside surface 36 of the cage 12 defines a depth of the cage between the backstop 16 and the impact surface 29. The depth of the cage 12 defines the maximum distance the baffle 14 is movable between the backstop 16 and the impact surface 29. In some embodiments, the depth of the cage 12 is between about four times and about fifteen times the thickness of the baffle 14. In other preferred embodiments, the depth of the cage 12 is between about four times and about ten times the thickness of the baffle 14.

FIG. 5 illustrates the free-floating planar baffle 14 in its most distal position against the backstop 16. This positioning would occur when a user exhales through the one-way breath trainer 100 causing air to flow out of the air hole 28 and push the free-floating planar baffle 14 off the air hole and abut the backstop 16. With the free-floating planar baffle 14 abutting the backstop 16, there remains flow paths 19 defined around the baffle. The flow paths 19 are formed within the inside surface 36 of the cage 12 and around an outer edge of the open space 38 formed by the guidance tracks 15. The flow paths 19 define a total cross-sectional area that is substantially equal to the cross-sectional area of air hole 28. This ensures a user will be able to readily inhale and exhale through the mouth insert 10 with minimum effort to move the baffle 14 within the cage 12. In alternative embodiments, the cross-sectional area of the flow paths 19 may be more or less than the cross-sectional area of the air hole 28.

The cage 12 may also have a retaining clip 40 extending from the distal end thereof. The retaining clip 40 is designed so that a person can attach a lanyard or other such device onto the retaining clip 40 so the breath trainer 100 may be hung from a person's neck while in use. This allows a user to simply spit the device out of their mouth when they need to take a break from use. In addition, this prevents a person from having to put the device in their pocket or on another surface that may be unsanitary. Further, if a person's hands are occupied, such as when riding a bike or lifting weights, the person will be free to simply spit the device out of their mouth if/when they feel the need to inhale deeply through their mouth.

In preferred embodiments, the cage 12 has a substantially oval shape and the open space 38 formed within the cage has a corresponding oval shape. The free-floating planar baffle 14 is sized such that it can move freely within the open space 38 formed within the cage but is large enough to completely block the air hole 28. The inventors have discovered that the oval shaped planar baffle 14, curved guidance tracks 15, oval shaped cage 12 with an x-shaped backstop 16 provide an effective geometric design to promote the free movement of the baffle within the open space 38 and align the baffle properly against the air hole 28 when a user inspires through their mouth. However, other geometric designs, such as circular, rectangular or any other geometric shape, may be used with the present invention.

Figure 7:
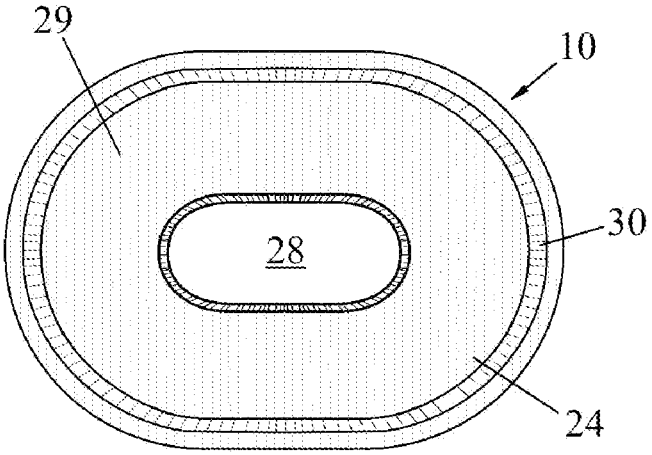
FIG. 7 is a rear view of an embodiment of a mouth insert for use with a one-way breath training device according to the present invention.
Figure 8:
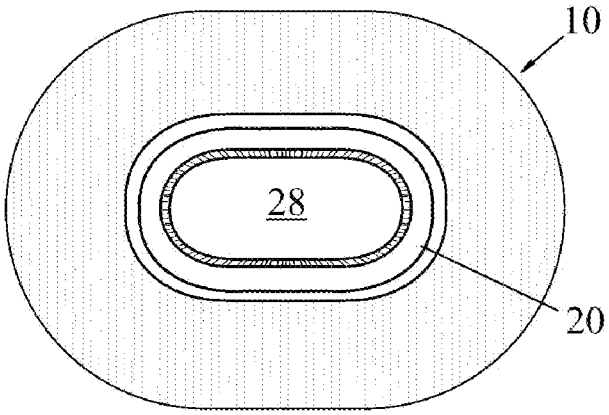
FIG. 8 is a front view of the mouth insert from FIG. 7.

FIG. 7 is a rear view of an embodiment of the mouth insert 10. FIG. 8 is a front view of the mouth insert of FIG. 7. The air hole 28 is defined substantially through the mouth insert 10 from the mouth side 20 through to the second side 24. The air hole 28 is surrounded by the impact surface 29 on the second side 24 of the mouth insert 10. Preferably, the air hole 28 is oval shaped and defined substantially through the center of the mouth insert. In alternate embodiments, the air hole 28 may have other geometric shapes. The size of the air hole 28 is configured such that the maximum amount of air flowing therethrough closely matches the maximum amount of air flow moving through the open space 38 of the cage and through the backstop openings 18. The air hole is smaller than the baffle 14 so that the baffle can easily cover the air hole when subject to inward suction forces.

In use, the one-way breath trainer 100 substantially blocks inhalation by the mouth. When a user places the mouth insert 10 of the breath trainer 100 into their mouth and attempts to breathe in through their mouth, air is drawn through the openings 18 of the backstop 16 creating a pressure differential across the elongated section 22 that forces the baffle 14 along the guidance tracks 15 and against the impact surface 29 at the second end 24 of the mouth insert 10. There, the baffle 14 completely blocks the air hole 28, thus preventing any more air from entering the air hole.

In one embodiment, when the baffle 14 engages the impact surface 29 of the mouth insert 10 to block the air hole 28, it produces an audible alert, such as a click, that alerts the user of an attempt at inspiration by the mouth. The audible alert also informs the user they are no longer able to breathe in through their mouth and must finish their inhalation via their nose or otherwise disengage from using the breath trainer 100. Preferably, the audible alert is generated by the force with which the baffle 14 engages the impact surface 29 and based on the materials used to make the one-way breath trainer 100. For instance, when the breath trainer 100 is made from hard plastics through a 3D printing process, the force need not be that great as the engagement of hard plastic on hard plastic will generate an audible alert. In other embodiments not using hard plastics, additional features may be present to generate the alert. For example, in soft plastic or rubber embodiments, it may be necessary to embed a hard plastic or metal strip in the baffle and on the impact surface so that the hard surfaces can engage and, with sufficient force from the inhalation, produce the audible alert.

After completing inhalation, the user must now exhale. With the breath trainer 100 still engaged, the user may exhale through their mouth. The air flow exiting the air hole 28 pushes against the baffle 14, moving it along the tracks 15 until it meets the backstop 16. With the air hole 28 now exposed, air can exit the cage around the baffle 14 and through the flow paths 19. Preferably, the breath trainer 100 is configured so that when the user exhales with enough strength to force the baffle 14 against the backstop 16, the flow resistance of the resulting flow channel is substantially equal to a flow resistance experienced by the user when exhaling without the breath trainer. In other words, the fully open flow resistance of the breath trainer is imperceptible to the user and preferably places no additional load on the user when exhaling. Alternatively, the breath trainer 100 is designed is to minimize the resistance a person may experience during exhalation through their mouth so that any additional perceived breathing load is negligible. In another embodiment, the breath trainer 100 is configured so that when fully open (i.e., baffle 14 abutting backstop 16), the total cross-sectional area of flow paths 19 substantially equals the minimum cross-sectional area of the air hole 28.

The breath trainer 100 may come in a variety of sizes that can be used for a variety of purposes. For instance, at-home breath training or meditation style uses may only require a miniature breath trainer whereas a person engaged in strenuous exercise may find it more suitable to use a larger sized device. The different size requirements correlate to a difference in activity level and thus a person's oxygen requirements. During strenuous exercise, a person's oxygen requirements are typically higher than the oxygen requirements of a person who is meditating. The increase in size of the breath trainer scales up the relative sizes of the air hole, the baffle and the cage, which allows a person to increase inspiration depth. In a larger sized breath trainer, the baffle continues to work against the air hole to block inspiration by the mouth. Further, the larger air hole and cage results in increased room for air to move through the flow paths 19 during exhalation by the mouth. This increased size is preferable during strenuous activities, such as weight training, running, mixed martial arts training or any other activity where a person needs to take deep breaths to support the body's oxygen requirements.

Figure 9:
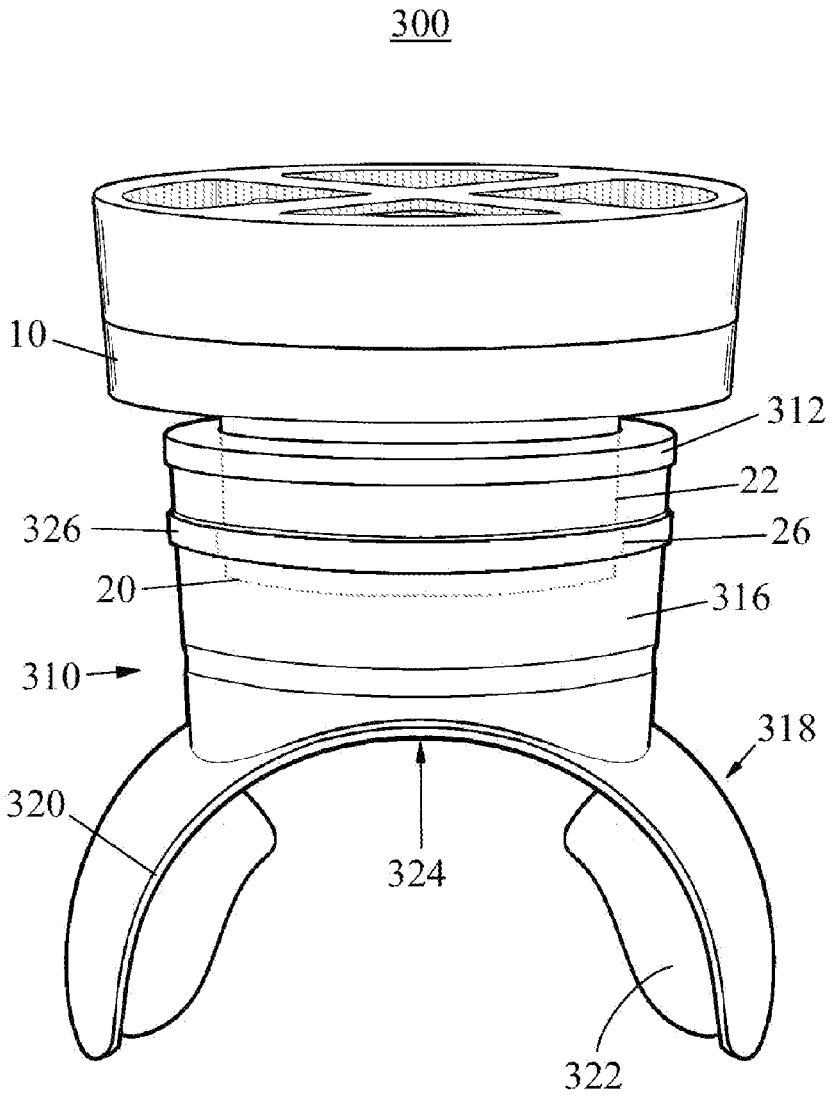
FIG. 9 is a partially transparent perspective side view of an alternative embodiment of a one-way breath training device according to the present invention.

FIG. 9 is a partially transparent perspective view of an alternate embodiment of a one-way breath training mouthpiece 300. The breath training mouthpiece 300 has essentially the same major components as the one-way breath trainer 100. The primary difference between the two embodiments is that the first end 20 of the mouth insert 10 is configured to engage with a mouthpiece 310. Note, the dashed lines in FIG. 9 represent the forward edge of the mouth insert 10 as engaged with the mouthpiece 310. A distal end 312 of the mouthpiece has an opening that extends into a hollow elongated section 316. The opening into the elongated section 316 of the mouthpiece 310 is configured to receive the first end 20 of the mouth insert 10 and surround the elongated section 22 of the mouth insert. The elongated section 316 continues into a bite plate 318. The bite plate 318 may be designed according to conventional mouthpiece designs having wall 320 conforming to the shape of a person's jaw and a bite surface 322 integrally formed with the wall 320 and extending inward. The wall 320 is sized such that a person can insert the mouthpiece into their mouth and surround it with their lips while their upper and lower teeth engage the bite surface 322. The opening extends from the distal end 312 through the elongated section 316 to the proximal end 324 and defines a hollow flow channel. In preferred embodiments, at least one grooved rim 326 circumvolves an inside surface of the elongated section 316. The retaining ring 26 of the mouth insert 10 is configured to engage the mouthpiece 310 by friction-fit within a groove on an inner surface of the grooved rim 326 to secure the mouthpiece 310 to the mouth insert 10.

In alternate embodiments, the mouthpiece may have multiple grooved rims 326 positioned at differing depths within the elongated section 316. The multiple grooved rims allow a user to select the position of the mouth insert relative to the mouthpiece which correlates to the force required to separate the mouth insert 10 from the mouthpiece 310 during exhalation. The deeper the insert 10 is positioned in the mouthpiece 310, the more exhalation force is required to separate the component pieces. Similarly, positioning the insert at the most distal groove results in lower exhalation force to separate the pieces. The ability to vary resistance against separation of the pieces due to the exhalation force exerted may be beneficial to certain persons using the breath training mouthpiece 300 during certain activities. For instance, during high energy exercise, a person may need to exhale harshly. Positioning the insert at the distal end ensures that during harsh exhales, the insert 10 is capable of being forcibly disengaged from the mouthpiece 310 as a safety precaution to allow the user to quickly recapture their breath without resistance. This may be necessary for users just beginning to use the device during training where it feels uncomfortable to limit their ability to exhale in a controlled manner. As the user becomes more comfortable using the breathing device, they can push the insert deeper into the mouthpiece to experience an increased resistance to the forcible separation of the mouth insert 10 from the mouthpiece 310 due to exhalation and thus continue to train themselves to take deep, controlled breaths during activity. There may be a series of grooved rims 326 positioned at different depths where each depth corresponds to a calculable exhalation force required to forcibly separate the component pieces by exhaling. This serial design provides a user the ability to train using the breath training mouthpiece in a stepwise manner, progressively moving the insert deeper into the mouthpiece as the user becomes accustomed to the previous depth and resistance to forcible separation.

The mouthpiece may be made from conventional polymer or rubber material as is common for other conventional mouthpieces. Further, it may be advantageous to make the bite surface out of a moldable rubber or polymer material so that a user can mold the surface to the profile of their teeth. Further, the bite surface may extend the length of a user's teeth profile so as to provide complete coverage of their teeth. This design of the mouthpiece may be beneficial for people using the training device during sleep so they do not unconsciously grind their teeth while asleep.

Figure 10:
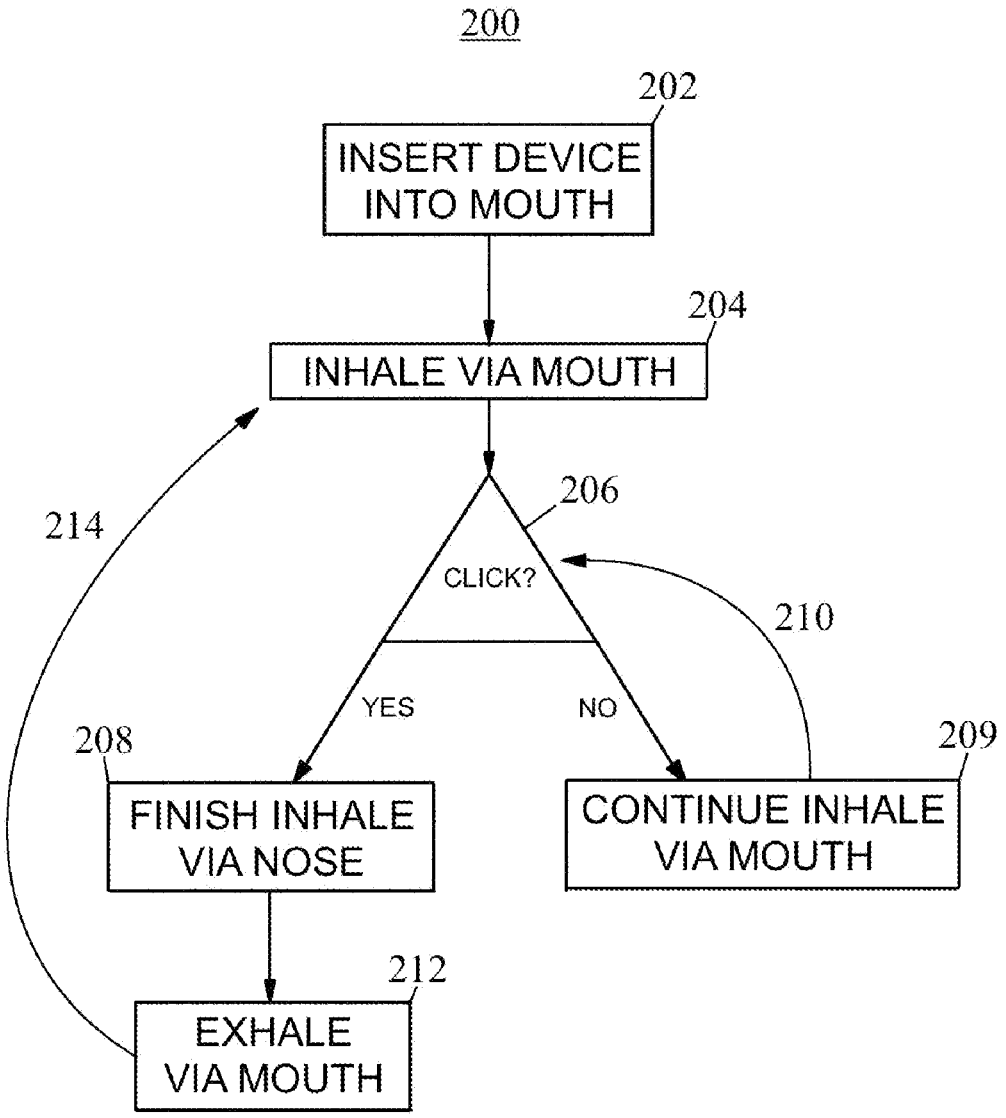
FIG. 10 is a flow chart diagraming the salient steps of a method for training a person to eliminate mouth breathing.

FIG. 10 is a diagram of a training method 200 to eliminate inspiration by the mouth. The method is applicable to all embodiments of the invention, including the one-way breath trainer 100 and the breath training mouthpiece 300. At step 202, a user engages the device with their mouth, creating an airtight seal between the user's mouth and the device. Once the seal has been created, at step 204, the user inhales through their mouth which causes air to be sucked in through the device. The air flowing in works against the baffle and begins to move it along the tracks toward the air hole. At step 206, if an audible 'click' is generated, the user is informed to finish the inhalation through their nose (step 208). The 'click' indicates to a user the air hole is now covered by the baffle and no more air can pass therethrough. If the user does not hear the 'click' they will continue inhaling through their mouth until the 'click' has been generated, at which point the inhalation can be stopped or otherwise completed through the nose (step 208). At step 212, once the user has finished inhaling through their nose with the air hole sufficiently blocked, they may now exhale through their mouth. The air being exhaled through the air hole works against the baffle to move it off the air hole, thus allowing air to pass through the air hole and out the cage through the flow paths. At step 214, the process goes back to step 204 and the breathing exercise is repeated.

The above-described training method works on principals of behavioral conditioning. That is, when a person begins to mouth breathe, an audible 'click' is generated and the air supply is cut off. To continue breathing, the person must now inhale through their nose. Repeated practice of this training method can condition the person's brain to avoid the 'click' while breathing by inhaling primarily through their nose. The training method may be practiced while sitting at home watching tv, driving, while at work or virtually any other activity. Repeated practice of the training method 300 can subconsciously teach the person the proper manner to breathe, e.g., in through the nose and out through the mouth, and thereby eliminate the many health risks associated with mouth breathing.

Exemplary embodiments of the invention have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A one-way breath training device, comprising:

a mouth insert having an air hole defined through the mouth insert from a first end to a second end, wherein the first end is configured to engage a person's mouth and the second end defines an impact surface;

a cage attached to the second end and configured for the passage of air, the cage having at least one guiding track and a backstop; and a baffle housed within the cage and movable between the backstop and the impact surface, wherein the baffle is configured to completely block air passage through the air hole when the baffle is positioned against the impact surface.

2. The one-way breath training device of claim 1, wherein the at least one guiding track comprises a plurality of guiding tracks.

3. The one-way breath training device of claim 2, wherein each of the guiding tracks defines a curvature extending from a distal end of the cage to a proximal end of the cage.

4. The one-way breath training device of claim 3, wherein the curvature of each of the guiding tracks is configured to minimize friction between an outer edge of the baffle and each of the guiding tracks.

5. The one-way breath training device of claim 3, wherein the curvatures are configured to center the baffle in the cage.

6. The one-way breath training device of claim 1, wherein the second end further comprises a means for removably attaching the cage to the mouth insert.

7. The one-way breath training device of claim 6, wherein the means for removably attaching the cage to the mouth insert comprises a groove defined about a perimeter of the second end and a ridge defined about a perimeter of a proximal end of the cage, wherein the groove is configured to receive the ridge.

8. The one-way breath training device of claim 1, wherein the first end further comprises a means to removably engage a mouthpiece.

9. The one-way breath training device of claim 8, wherein the means for removably engaging a mouthpiece comprises a retaining ring formed at a proximal end of the first end, the retaining ring configured to frictionally engage an inner surface of an opening defined through the mouthpiece.

10. The one-way breath training device of claim 1, wherein normal inspiration causes a pressure differential in the air hole sufficient to move the baffle.

11. The one-way breath training device of claim 10, wherein the baffle moves against the impact surface and covers the air hole when a negative pressure differential is created by air being sucked through the air hole.

12. The one-way breath training device of claim 1, wherein the mouth insert further comprising an elongated portion connecting the first end to the second end, wherein the air hole extends through the elongated portion from the first end to the second end.

13. The one-way breath training device of claim 12, wherein the elongated portion is sized to accommodate a user's lips circumvolving the first end.

14. The one-way breath training device of claim 1, wherein the baffle comprises a free-floating disc having rounded edges.

15. The one-way breath training device of claim 1, wherein the baffle comprises a substantially oval-shaped disc.

16. The one-way breath training device of claim 1, wherein the baffle generates an audible alert when the air hole is completely blocked.

17. The one-way breath training device of claim 1, further comprising at least one opening defined through the back-stop to allow air to enter the cage.

* * * * *